United States Patent [19]

Goldwater

[11] 4,157,741

[45] Jun. 12, 1979

[54] PHASE PLUG

[76] Inventor: Alan J. Goldwater, 1780 Chanticleer Ave., Santa Cruz, Calif. 95062

[21] Appl. No.: 934,218

[22] Filed: Aug. 16, 1978

[51] Int. Cl.[2] ..... G10K 13/00; H04R 7/00

[52] U.S. Cl. ..... 181/159; 179/115.5 H; 181/156

[58] Field of Search ..... 181/159, 152, 166, 156; 179/115.5 H

[56] References Cited

U.S. PATENT DOCUMENTS

| | | | |
|---|---|---|---|
| 1,707,545 | 4/1929 | Wente | 181/159 |
| 1,930,915 | 10/1933 | Wente | 179/115.5 H |
| 2,037,187 | 4/1936 | Wente | 181/159 |
| 2,058,208 | 10/1936 | Blattner | 181/159 |
| 3,852,529 | 12/1974 | Schafft | 181/159 |
| 3,991,286 | 11/1976 | Henricksen | 179/115.5 H |
| 4,050,541 | 9/1977 | Henricksen | 181/159 |

*Primary Examiner*—Stephen J. Tomsky
*Attorney, Agent, or Firm*—Robert G. Slick

[57] ABSTRACT

A phase plug structure is described which is an intermediate element between a conventional fiber cone loudspeaker and an exponential horn. The purpose of the phase plug is to equalize acoustical path lengths and thereby minimize high-frequency cancellations caused by phase differences. The design of the phase plug is based upon an analysis of both low-frequency and high-frequency horn behavior. A usable bandwidth of four octaves is obtained over a sharply-defined angle of radiation.

In accordance with another embodiment of the invention, an enclosure is provided having a first exponential radiator, of relatively small size attached to the front of the speaker, and a relatively large exponential radiator coupled to the rear surface of the speaker for improved base response.

7 Claims, 6 Drawing Figures

PHASE PLUG

BACKGROUND

This invention relates to a phase plug structure which serves as a phase equalizing means in a loudspeaker system. In a typical system using an exponential horn, a compression chamber located between the speaker diaphragm and the horn transfers energy between these elements. Typically, to reduce distortion, the surface area of the diaphragm is relatively large compared to the cross-sectional area of the horn throat. The size difference causes acoustic waves from the center of the diaphragm to reach the throat of the horn before vibrations from the periphery of the diaphragm which must travel across the compression chamber before reaching the horn. This causes the acoustic vibrations from the various portions of the diaphragm to have phase differences between them. These phase differences can result in phase cancellations at particular frequencies, thereby limiting the high-frequency response of the compression horn transducer. Use of phase plugs having annular rings therein which equalize the path lengths between the various portions of the diaphragm and the horn is one means of minimizing these phase cancellations.

SUMMARY OF THE INVENTION

It is an object of the present invention to provide a phase plug for use in an acoustic system.

It is another object of the invention to provide a phase plug usable over a wide bandwidth, e.g. four octaves, with low distortion.

Yet another object of the invention is to provide a phase plug with a relatively simple structure which can be easily manufactured.

Yet another object of the invention is to define the surface contour of the phase plug using relatively simple mathematical formulas.

In accordance with the preferred embodiment of the invention, a phase plug of molded plastic or other suitable material may be easily and inexpensively manufactured. Said plug equalizes the path lengths from various portions of the diaphragm to the horn throat center line.

In accordance with another embodiment of the invention, a double radiator structure is employed, namely a relatively small exponential radiator working off of the front of the loudspeaker through the phase plug of the present invention and a relatively large exponential radiator coupled acoustically to the rear surface of the loudspeaker.

DESCRIPTION OF THE PREFERRED EMBODIMENTS

Figure 1:
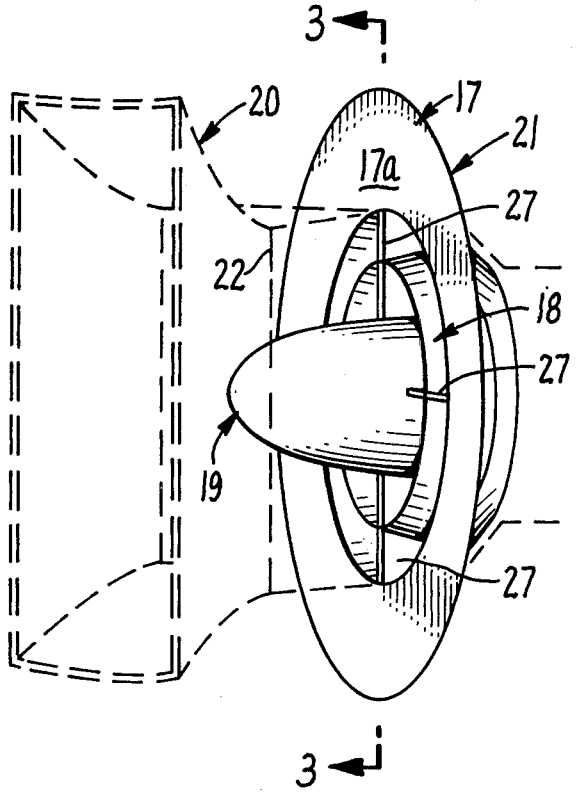
FIG. 1 is a front perspective side view of the phase plug and an associated exponential horn.
Figure 2:
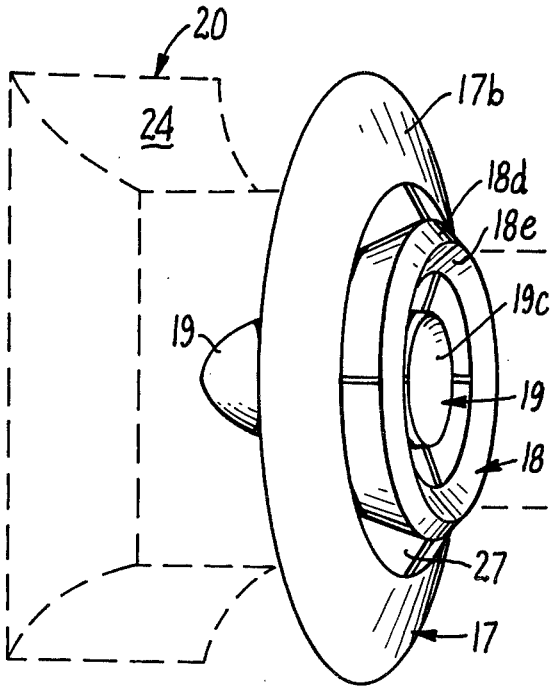
FIG. 2 is a rear perspective side view of the phase plug and the associated exponential horn.
Figure 4:
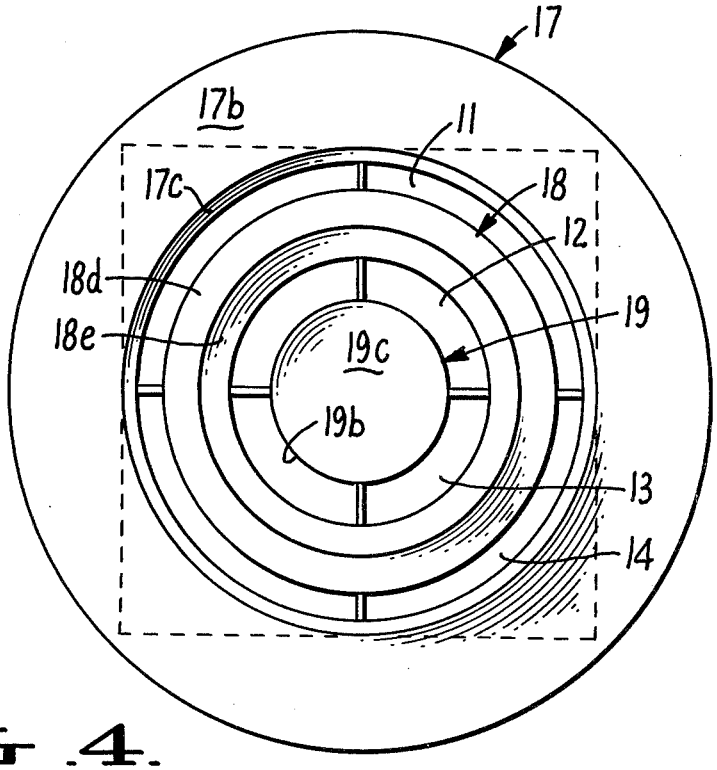
FIG. 4 is a front view of the phase plug.

Referring now to the drawings and particularly FIGS. 1 through 5, there is shown a phase plug, generally designated 21, which acts as an acoustical coupler between a loudspeaker 25 and an exponential horn 20.

Phase plug 21 consists of an outer ring 17, an intermediate section 18, and a central hub 19.

The loudspeaker 25 has a voice coil 8 which is coupled to a dust cap 2 and a cone 1.

As was previously mentioned, the phase plug 21 acts an acoustic transformer between the loudspeaker 25 and the exponential horn 20. The exponential horn has a rectangular throat 22 and is provided with an intermediate section 23 to provide for the smooth convergence between the round element of the phase plug structure and the square throat.

Figure 3:
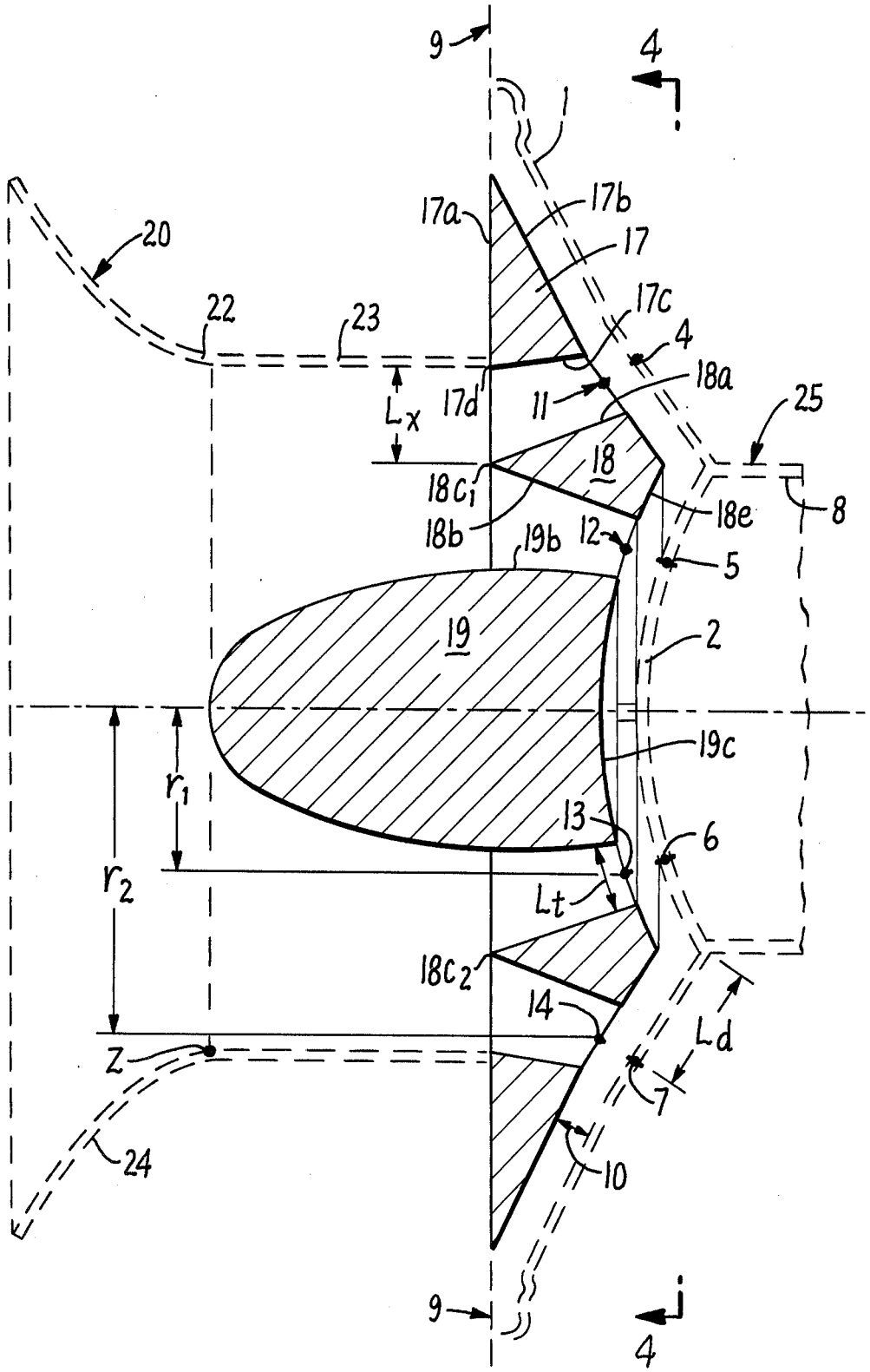
FIG. 3 is a vertical cross-sectional view of the loudspeaker, the phase plug, and the associated radial horn.
Figure 5:
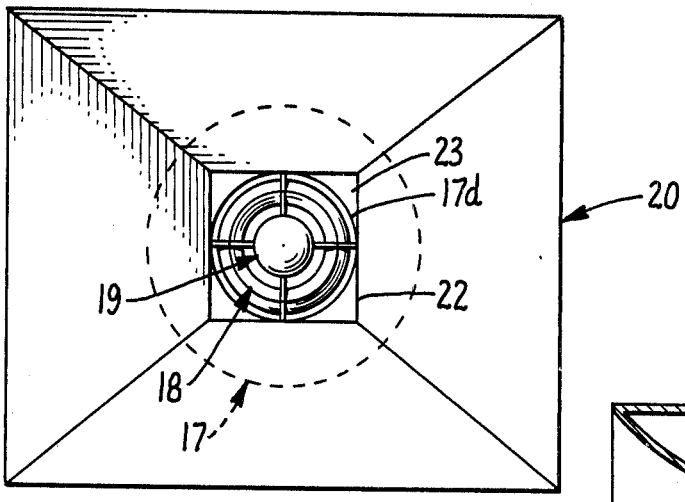
FIG. 5 is a front view showing a loudspeaker and phase plug mounted in a rectangular exponential horn.

The phase plug, generally designated 21, is composed of three principal parts, namely an outer ring 17, an intermediate section 18, and a central hub 19. As is best seen in FIG. 3, a portion of central hub 19 extends into the throat of section 23 of the horn. Beyond the rectangular throat 22 of the horn is the exponential flare section 24.

The phase plug 21, which consists of the three principal parts previously mentioned, has thin ribs 27 to hold the parts of the plug in the described concentric relationship.

The outer ring 17 has a flat front face 17*a*, a conical rear face 17*b*, the contour of the face 17*b* being generally that to complement the cone 1 of the loudspeaker, and a lower surface 17*c*. The intermediate section 18 has an upper surface 18*a* and a lower surface 18*b* which converge to form a sharp edge $18c_1$ at the transition line into throat 23 of the horn. The space between the surfaces 17*c* and 18*a* forms an exponential chamber. The rear surface of intermediate section 18 has two walls 18*d* and 18*e* which form an obtuse angle to each other and which permit the proper spacing between the fiber cone 1 and the dust cap 2, as is later brought out in detail.

The central hub 19 has a bulbous outer surface 19*b*, the contour of which is selected so that the space between surface 19*a* and the inner surface of the intermediate section 23 of horn 20 is exponential. Further, surface 19*b* is contoured so that this surface, together with the surface 18*b*, provides an exponential passage between the sections 18 and 19. The rear surface of section 19, designated 19*c*, is concave and congruent with the curve of the dust cap 2.

It will be apparent from the above that the surfaces of the various elements of the phase plug nearest the loudspeaker, namely the surfaces defined by 17*b*, 18*d*, 18*e*, and 19*c*, are spaced uniformly from the moving parts of the loudspeaker, namely the paper cone 1 and the dust cap 2. The amount of this spacing will be brought out in detail hereafter.

The design of the phase plug begins with selection of a desired bandwidth and an appropriate driver (fiber cone loudspeaker). The designer must make his choice of bandwidth and driver with the knowledge that the efficiency-bandwidth product of the system is approximately constant for a given driver irrespective of the horn design. Therefore, the greater the bandwidth obtained, the lower the mid-band efficiency.

In the following analysis, the complete horn structure will be considered in three distinct sections:

1. The primary, or phase plug flare area;
2. The intermediate, or "transitional" flare area;
3. The radial, or "dispersion-control" flare area. Each of these sections serves a different function in the behavior of the horn; all share a common flare rate based on the well-known exponential horn equation:

$$S_x = S_o e^{kx}$$

where $S_x$=cross-sectional area of the horn at distance X from the origin ("throat");

$S_o$=cross-sectional area at the throat;

k=flare constant=$4\pi f_c/C$ (1) and $f_c$=lower cutoff frequency of the horn and C=velocity of sound in air.

SECTION I

Selection of the bandwidth determines the horn's lower cut-off frequency, $f_c$, and the maximum path length, $L_d$, from the driver to the horn throat(s) center line. Lower cut-off frequency, $f_c$, should be selected 0.25 to 0.50 octave below the desired lower bandwidth limit. Such a selection avoids intermediate frequency response irregularities caused by horn fabrication errors and minimizes high-frequency distortion caused by excessively slow flare.

A path length parameter, $L_d$, is calculated from the known equation $L_d=(\sqrt{3}C/2\pi f_h)$ where C is the velocity of sound in air and $f_h$ is the desired high-frequency bandwidth limit.

The phase plug flare exhibits radial symmetry coaxial with that of the loudspeaker. With reference to FIG. 3, design of the phase plug may be accomplished as follows:

(1) on an orthographic (cross-section) projection of the loudspeaker cone 1 and dust cap 2 determine four points, 4, 5, 6 and 7, spaced at a distance $L_d$ from the voice coil attachment 8. Two of these points, 4 and 7, lie along the surface of the speaker cone 1, and two, 5 and 6, are located on the speaker dust cap 2. These four points define the centers of origin of two concentric toroidal exponential horns which comprise the phase plug flare.

(2) Draw a line 9 flush with the speaker mounting surface. Determine the excursion limit of the speaker cone at the desired operating level and establish the driver to phase plug spacing 10, at 1.5 times this distance. Such spacing, 10, provides protection to the driver in case of extreme low-frequency transients without substantially degrading the high-frequency response. Transpose the speaker contour distance, 10, to get the phase plug inner contour. Finally, project the four points, 4, 5, 6 and 7, from the speaker to the phase plug contour to locate throat center line points 11, 12, 13 and 14.

(3) Select the minimum loading ratio consistent with the needed high-frequency response. This ratio is equal to the driver equivalent area, $S_d$, divided by the throat cross-sectional area, $S_o$. Because mid-band efficiency varies inversely with the ratio $S_d/S_o$, proper selection of the minimum loading ratio insures the optimum trade-off between bandwidth and efficiency. The actual throat area, $S_o$, may be calculated from the known driver equivalent piston area, $S_d$. By way of example, for a bandwidth of four octaves,, the ratio $S_d/S_o$ will be approximately 3.5 to 1 for a nominal six-inch speaker diameter. $S_d$ is equal to 28 in$^2$ and $S_o$ is equal to 8 in$^2$.

(4) The throat slot width, $L_t$, may be calculated from the equation $$L_t = \frac{S_o}{2\pi(r_1 + r_2)},$$

where $r_1$ and $r_2$ are respectively the radii of the throat center lines as shown in FIG. 3. Direct calculation of throat radii $r_1$ and $r_2$ is possible but would require reduction of the driver geometry to mathematical terms, a difficult and unnecessary step. A simpler method is to measure the throat radii directly from the drawing as shown in FIG. 3. Once the throat slot width, $L_t$, is determined, the width of the throat openings may be defined by marking points on the phase plug inner contour $L_t/2$ on either side of the center line points 11, 12, 13 and 14.

(5) The circular junction line of the adjacent sides of the two throat horns is defined by locating two points 18$c_1$ and 18$c_2$ on the mounting surface line 9. Point 18$c_1$ is equidistant from points 4 and 5 on the speaker and point 18$c_2$ is equidistant from points 6 and 7 on the speaker. The adjacent sides, which may be conical in shape, define a ring of trapezoidal cross-sectional area which separates the two throat horns.

(6) Treating each horn separately, the remaining surfaces up to the mounting line may be calculated from the known exponential horn equation $S_x=S_o e^{kx}$, where $S_x$ is the cross-sectional area of the horn at a distance X from the origin ("throat"), $S_o$ is the cross-sectional area at the throat, and k is the flare constant. The flare constant k is equal to $(4\pi f_c/C)$. $F_c$ is the lower cut-off frequency of the horn, and C is the velocity of sound in air. The actual exit width, $L_x$, of the horn at the mounting surface is given by the equation $L_x=(S_x/2\pi r)$ where $r=(r_1+r_2)/2$. In many cases, the flare of these surfaces is so close to being conical that it may be treated as conical since a fix of 1% is sufficient. The exact flare may be calculated if necessary, but simply treating the surface as conical is of great advantage in fabricating tooling for manufacturing the parts.

(7) Having thus defined the contour of the horn, the remaining surfaces of outer ring, 17, of the phase plug are defined by transposing the speaker, 1, contour and by the line, 9, flush with the speaker mounting surface.

(8) The outer contour of the central hub 19 is difficult to define mathematically but it is a bulbous shape and is so proportioned that it, together with the inter surface of the transitional section 23 forms an exponential space.

SECTION II

Transitional Flare Area

The transitional flare section is a toroidal exponential horn defined by a complex outer section and a central plug section, the contour of which is calculated to yield an exponential composit flare. The contour of the outer section taken on a plane parallel to the driver-mounting surface is circular at the mounting plane (outer terminus of phase plug section) and rectangular at its junction with the radial section. Its cross-sectional area taken without the central plug is a conical function of the distance, X, from the throat. Its cross-sectional contour at any distance, X, is found by ratio-averaging between rectangular and circular contours. It is desirable to have the smaller rectangular dimension larger than the diameter of the circle so that the outer section may be fabricated in one piece with the radial section, this being a primary reason for inclusion of the plug in the design. The length of the transitional flare is determined by finding a point, Z, where the slope of the vertical flare contour, to be developed hereinafter in section 3, reaches zero. It is at this point that the radial section begins. The distance to point Z may be calculated by setting the first derivative of the flare equation, $$S_x = S_o e^{kx}$$

equal to zero.

SECTION III

Radial

The function of this section is to control the angle of radiation. As the wavefront expands rapidly in the horizontal plane, area calculations are based on the surface area of a cylindrical section bounded by two planes at angle $\phi$ equal to the desired horizontal radiation angle. The two planes are set to intersect the vertical edges of the rectangular end of the transition flare outer section. These planes form the vertical sides of an exponential horn of radial form. The remaining symmetrical top and bottom contours are calculated to yield an exponential area function.

The following is a practical embodiment of the phase plug designed for a 12 inch diameter loudspeaker. The letter references refer to letters on FIG. 3 of the drawings and all dimensions are in decimal inches.

Systems parameters:

$f_c = 200$ hz $f_h = 3.5$ khz $\phi = 90°$

Driver Nominal Diam. = 12"

$S_d/S_o = 4$

1. $L_d = \sqrt{3}\ C/2\pi f_h = 1.02''$
2. Excursion limit = 0.25" determined empirically d = 0.375"
3. $r_1 = 1.22''$
   $r_2 = 2.68''$
   determined by measurement of drawing.
4. Driver equivalent piston area = 71 in²

$$S_o = 71/4 = 17.75 \text{ in}^2$$

5. $L_t = [S_o/2\pi(r_1 + r_2)] = 0.72''$
   $L_{t/2} = 0.36''$
6. mean throat length = 1" determined by approximation $$S_x = S_o e^{kx}$$

$$= 21.5 \text{ in}^2$$

$K = 4\pi fc/C = 0.19$ r = 1.95" determined by measurement $L_x = S_x/2\pi r = 1.75''$ $L_x/2 = 0.875''$ 7. Exit diam. of phase plug = 5.66" determined by measurement $$X' = \frac{S_o e^{kx}}{2\sin(\frac{\phi}{2})h} \leq \frac{S_o e^{kx}}{2\sin(\frac{\pi}{4})(5.6)} = \frac{S_o e^{kx}}{7.98} \text{ implies } h \geqq 5.6$$

$$X' = \frac{Y}{2\sin(\phi/2)} \geqq 3.96\ Y \geqq 5.6$$

$$\frac{S_o e^{kx}}{7.98} \geqq x' \geqq 3.96\ x \geqq \frac{Ln\frac{31.36}{S_o}}{k} = 3.0''$$

8. For fabrication convenience it is determined that the transition terminates at x = 3.5" (≧30) with $S_x = 34.5''$, corresponding to a square exit of dimensions 5.87"×5.87".
9. Transition flare parameters:
   Origin diameter = 5.66"
   Origin $S_x = 21.5$ in²
   Exit dimensions 5.87" = 5.87"
   Exit $S_x = 34.5$ in²
   Length = 2.5"

The outer contour is drawn as shown.

10. The outer contour area function is:

$$S_x = 25.16 + 3.74\ (x-1)$$

The required function for the hub is:

$$S_x = [25.16 + 3.74\ (x-1)] - 17.75e^{.19x}$$

$$r_x = \sqrt{\frac{[25.16 + 3.74\ (x-1)] - 17.75e^{.19x}}{\pi}}$$

| x | $r_x$ |
|---|---|
| 1.0 | 1.08 |
| 1.5 | 1.04 |
| 2.0 | 0.97 |
| 2.5 | 0.84 |
| 3.0 | 0.63 |
| 3.2 | 0.50 |
| 3.4 | 0.29 |
| 3.5 | 0.00 |

The complete phase plug is described as follows, in semi-polar coordinates (x, r) [Origin (0,0) is established by setting X=0 at throat origin of phase plug.]:

Outer ring: triangular cross-section defined by the points (1.0, 4.6), (0.2, 3.0), (1.0, 2.83).

Inner ring: trapezoidal cross-section defined by the points (1.0, 1.96), (−0.2, 2.42), (−0.45, 2.0), (−0.2, 1.55).

Hub: complex cross-section defined by the following points, in sequence:

| X | R |
|---|---|
| 0.10 | 0.00 |
| .09 | 0.50 |
| 0.00 | 0.90 |
| 1.00 | 1.08 |
| 1.50 | 1.04 |
| 2.00 | 0.97 |
| 2.50 | 0.84 |
| 3.00 | 0.63 |
| 3.20 | 0.50 |
| 3.40 | 0.29 |
| 3.50 | 0.00 |

For the actual phase plug surfaces the above-defined cross-sections are rotated about the x-axis through 360°.

Figure 6:
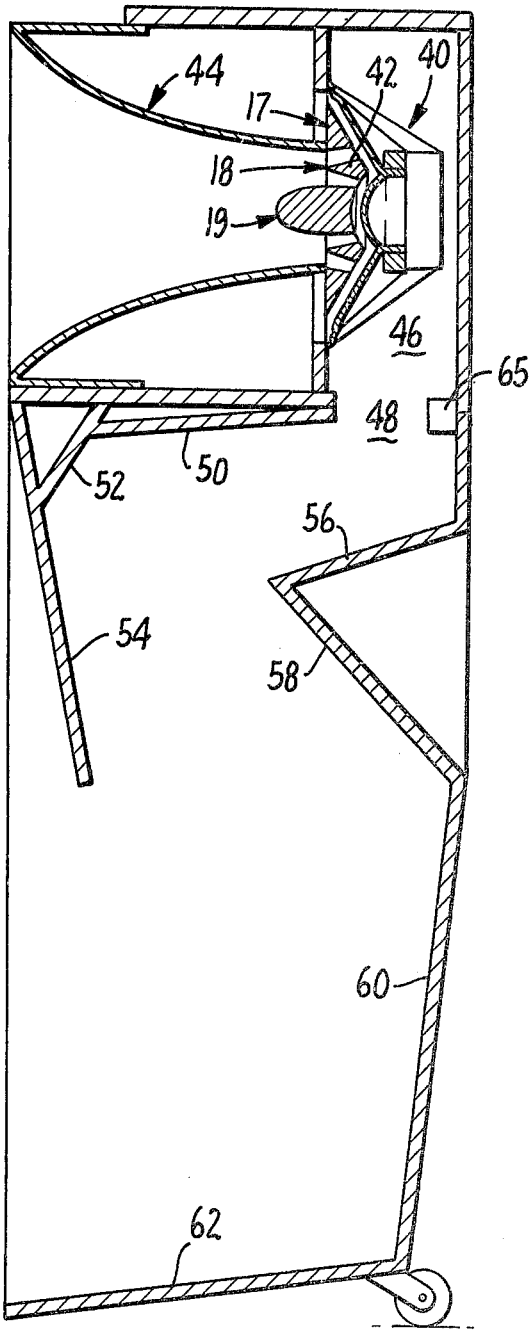
FIG. 6 is a side view of another embodiment of the invention wherein two exponential radiators are used, one working off the front of the loudspeaker through the phase plug of the present invention and the other coupled to the rear of the loudspeaker.

In FIG. 6 there is shown another application of a phase plug of the present invention. In this application, it is possible to get more than four octaves since a small horn is used for mid-range and a large horn, working off to the back of the loudspeaker, is employed for the base notes. Here the loudspeaker, generally designated 40, is provided with a phase plug 42 and the phase plug is attached to a first exponential horn 44. The relationship of speaker, phase plug and horn is exactly as previously described. The loudspeaker is mounted in a chamber 46 having a throat 48 leading to the baffles 50, 52, 54, 56, 58 as well as the back 60 and 62, all of which provide a base exponential horn. A porous material 65 in the throat 48 serves as a low pass filter. Thus, by employing two exponential horns, one a mid-range horn working off of the front of the speaker through a phase plug of the present invention, and a rear exponential horn working off of the rear of the speaker, one is able to achieve a broad frequency response. Preferably the entire phase plug, i.e. the parts 17, 18 and 19, as well as the ribs 27, are cast as a single integral unit of plastic.

I claim:

1. In a loudspeaker and exponential horn combination, a phase plug or acoustic transformer between the front of said loudspeaker and said horn wherein said loudspeaker has a voice coil coupled to a convex dust cover for the voice coil, the periphery of the dust cover being attached to an outward-flaring paper cone, creating an obtuse angle between the dust cover and the cone, said phase plug including three parts, namely:

a. a central member having a round cross-section and having a rear surface congruent with the center portion of said dust cap and having a bulbous front surface, b. an intermediate ring portion having an angular rear surface congruent with the intersecting surfaces of the cap and cone and having front surfaces forming an acute angle, c. an outer ring having a rear surface conforming to the peripheral surface of the cone and having a substantially flat front surface, the rear surfaces of said elements a, b and c being spaced substantially equally from said cap and cone and spaces between said elements a and b and between said elements b and c of a slightly outwardly diverging configuration.

2. The combination of claim 1 wherein the spacing between the rear surfaces of said elements a, b and c and the front surfaces of said cap and cone is at least 1.5 times the maximum distance said cone will move when operated at the maximum volume level and presented with a sinusoidal signal having a frequency equal to the lowest frequency in the desired bandwidth.

3. The combination of claim 1 wherein the three elements a, b and c are held in concentric alignment by radial fins.

4. The structure of claim 3 wherein the elements a, b and c and the fins form parts of an integral, single piece casting.

5. The combination of claim 1 wherein the size and orientation of the elements a, b and c are oriented with respect to each other such that the aperture between elements a and b forms a toroidal exponential horn and aperture between the elements b and c forms a second toroidal exponential horn, said horns being substantially concentric.

6. The combination of claim 1 wherein the element a having a bulbous portion is so proportioned with respect to the horn that it projects into said horn having a chamber formed between the bulbous portion and the horn forming a single exponential horn.

7. The combination of claim 1 wherein a second exponential horn of larger size is coupled to the rear of said loudspeaker.

* * * * *